United States Patent [19]

Williams et al.

[11] 4,314,788

[45] Feb. 9, 1982

[54] CROP HANDLING APPARATUS

[76] Inventors: Rodney B. Williams, Shandon Star Rte., Penman Springs Rd., Paso Robles, Calif. 93446; Jerry A. Taylor, 600 W. "H" St., Dixon, Calif. 95620

[21] Appl. No.: 114,886

[22] Filed: Jan. 24, 1980

[51] Int. Cl.[3] ..... B65G 65/23

[52] U.S. Cl. ..... 414/425; 414/393; 298/1 B

[58] Field of Search ..... 414/304, 393, 421, 425, 414/539; 298/1 B

[56] References Cited

U.S. PATENT DOCUMENTS

| | | | |
|---|---|---|---|
| 172,228 | 1/1876 | White . | |
| 1,088,100 | 2/1914 | Saunders et al. | 414/393 |
| 1,805,489 | 5/1931 | Kerr et al. . | |
| 2,477,707 | 8/1949 | Walz . | |
| 2,573,584 | 10/1951 | Tourneau . | |
| 2,876,917 | 3/1959 | King . | |
| 2,923,423 | 2/1960 | Maney . | |
| 2,931,523 | 4/1960 | Nelligan | 414/539 |
| 3,139,998 | 7/1964 | Seaman . | |
| 3,443,703 | 5/1969 | Matsumoto . | |

FOREIGN PATENT DOCUMENTS

| | | | |
|---|---|---|---|
| 52172 | 6/1934 | Norway | 298/1 B |

*Primary Examiner*—Robert W. Saifer
*Attorney, Agent, or Firm*—Henderson & Sturm

[57] ABSTRACT

An open-topped container is constructed with a plurality of compartments, each having its own discharge opening and each having its own liner of the type that can be selectively rolled up or unrolled according to loading and unloading operations. Each liner is connected to its own biasing means which is effective to yield and lower the liner as the compartment is loaded and effective to recover to elevate the liner to facilitate unloading, all for the purpose of handling material, such as fruits and vegetables and the like, in such a way as to eliminate or at least minimize damage thereto.

12 Claims, 10 Drawing Figures

CROP HANDLING APPARATUS

BRIEF SUMMARY OF THE INVENTION

Containers with roller-actuated liners are well known in the art, the basic structure including a flexible hammock-like liner affixed along one edge to the floor of the container at its discharge opening and connected at its opposite edge to a roller mounted in an elevated position along a container wall opposed to the discharge opening. In the U.S. Pat. to King, No. 2,876,917, the roller is actuated by a hand wheel. In the U.S. Patent to Seaman, No. 3,139,998, a pair of bag-like liners is raised and lowered pneumatically, the raising being incident to discharging the container via a floor-mounted hopper.

The present invention affords marked improvements over the prior art. One feature is to utilize one or more spring-loaded or biasing devices to control the rollers, the devices yielding to allow gradual descent of the liner as load is received, thus cushioning the shock usually resulting when fruits, vegetables etc. are dropped. When the container or compartment is full, the liner completely covers the inside of the container. As the material is unloaded, as via a open side of the container, the load lightens and the spring device causes the liner to rise, gradually increasing the slope thereof toward the discharge opening.

A further feature of the invention is to provide a multi-compartmented container, each compartment having its own liner and each liner being individually controlled for separate loading and unloading of the compartments.

Further feature and advantages of the invention will appear as a preferred embodiment thereof is set forth in the ensuing description and accompanying drawings.

DETAILED DESCRIPTION

Figure 1:
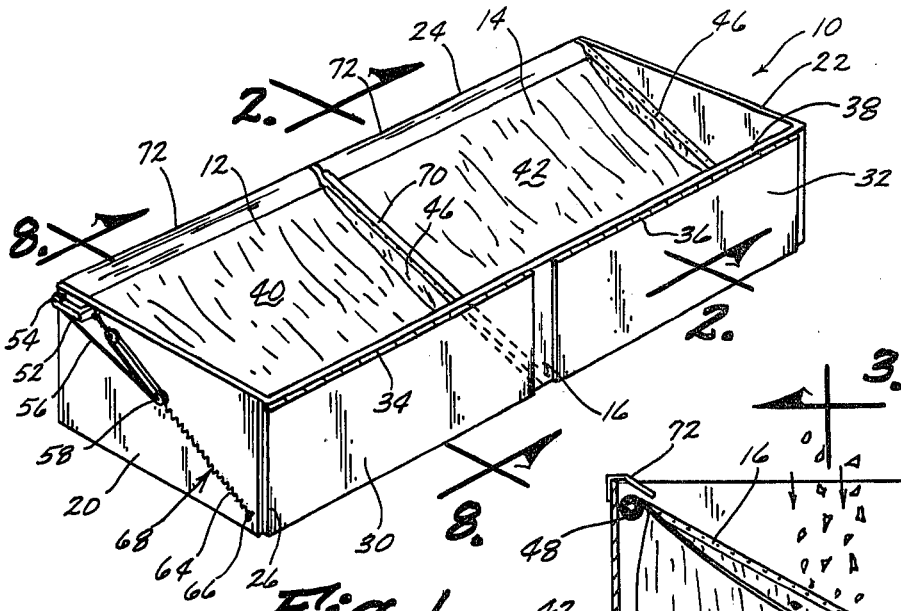
FIG. 1 is a perspective view illustrating a representative dual-compartmented container embodying a preferred form of the invention.
Figure 2:
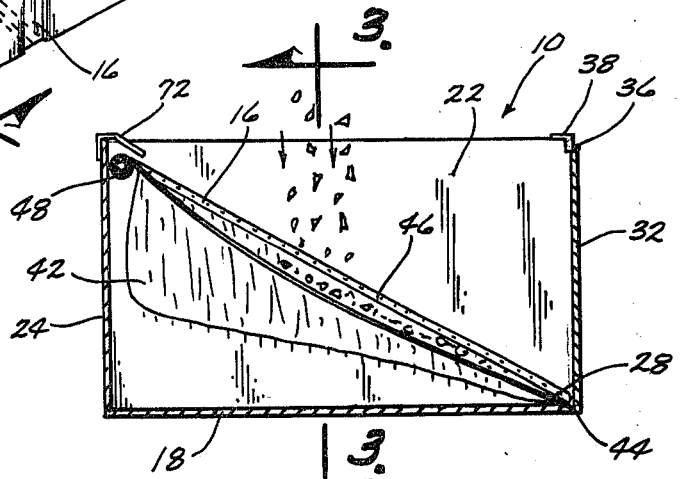
FIG. 2 is a section on the line 2—2 of FIG. 1.

The container is designated in its entirety by the numeral 10 and has a plurality of open-topped compartments 12 and 14 separated by an intermediate divider wall 16 with a sloped upper edge. This wall 16 is fixed in any suitable manner to a floor 18 and rises upwardly from the floor. The opposite end walls 20 and 22 are also fixed to the floor, along with a common rear wall 24. The side of the container opposite to the rear wall 24 is provided with a pair of discharge openings 26 and 28 for the compartments 12 and 14, respectively. These openings are closed during the loading stage of operation by doors or covers 30 and 32, respectively, which are hinged along their upper edges at 34 and 36, respectively to a cross member 38 that is connected to the end walls and is connected to the divider wall 16. The doors close the compartments individually. Any suitable latch means (not shown) may be used to selectively hold the doors closed and to selectively release them for opening or discharge.

Figure 3:
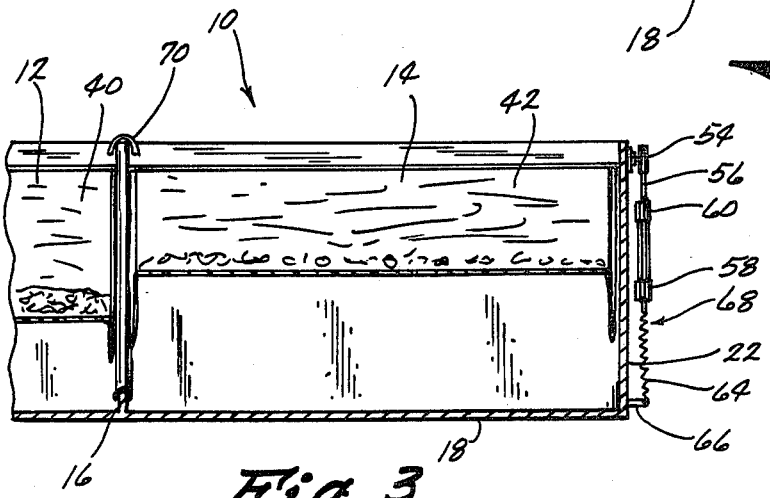
FIG. 3 is a partial section as seen along the line 3—3 of FIG. 2.
Figure 4:
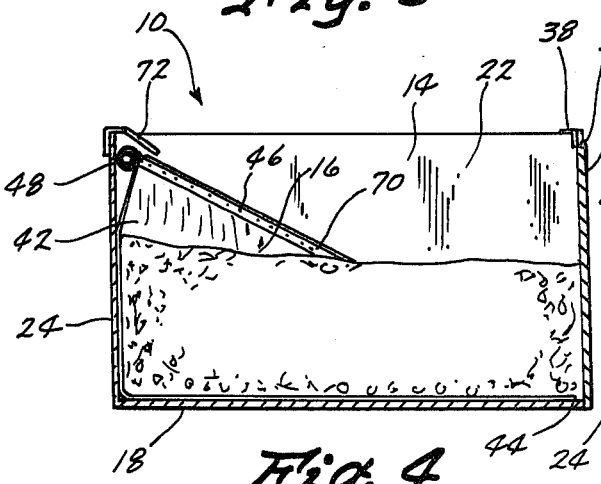
FIG. 4 is a section similar to FIG. 2 but showing the compartment fully loaded.
Figure 8:
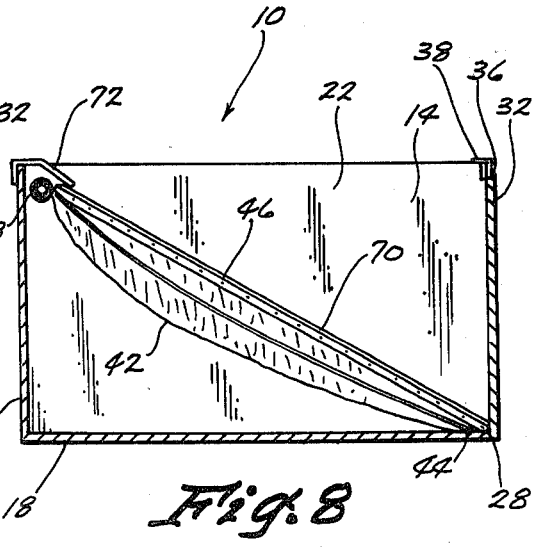
FIG. 8 is a cross sectional view taken along line 8—8 of FIG. 1.

According to the invention, the compartments are respectively equipped with bag-like liners 40 and 42, which may be of any known flexible, relatively strong material. Since these liners are identical, a description of one will suffice for both. Each liner, when full (FIG. 4) occupies substantially its entire compartment and thus leaves no open corners into which loaded material may become lodged. Each liner is fixed along its front edge, at its discharge opening, to the floor, as at 44 and is further fixed along the top edges of inner walls 16 and on its opposite sides to the associated container walls, as seen at 46. The rear edge portion of each liner is carried by a roller 48. These rollers are here shown as paralleling the rear container wall and as being coaxial with each other. The rollers are, however, separate from each other, and each serves as means for winding and unwinding its liner. The rollers are journalled in the end and divider walls in any suitable manner. Each roller has a shaft 50 extending coaxially outwardly beyond the associated end wall, best seen in FIGS. 6 and 7 (See also FIG. 3). When the compartments are empty, or prior to loading, the liners are wound up on the repective rollers and, as the load is received via the open tops of the compartments, the liners, unwinding from the rollers in a manner to be described below, yield in hammock-fashion so as to cushion the dropped material, thus preventing or minimizing damage, which is important when fruits, vegetables, etc. are being handled.

Figure 6:
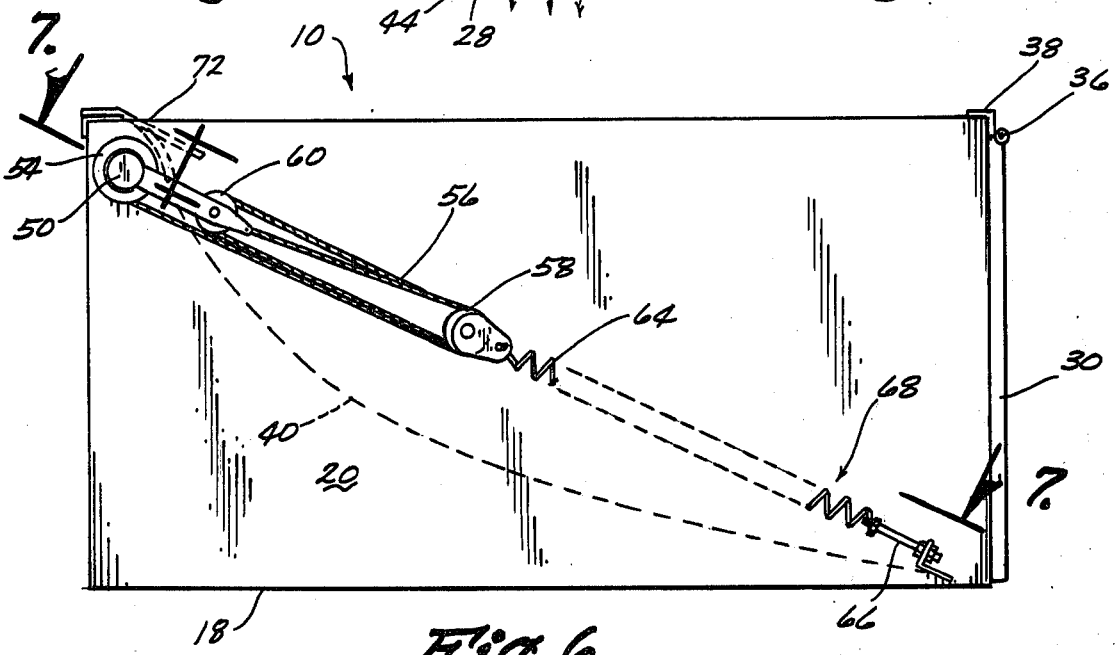
FIG. 6 is an enlarged end view showing one of the biasing devices.
Figure 7:
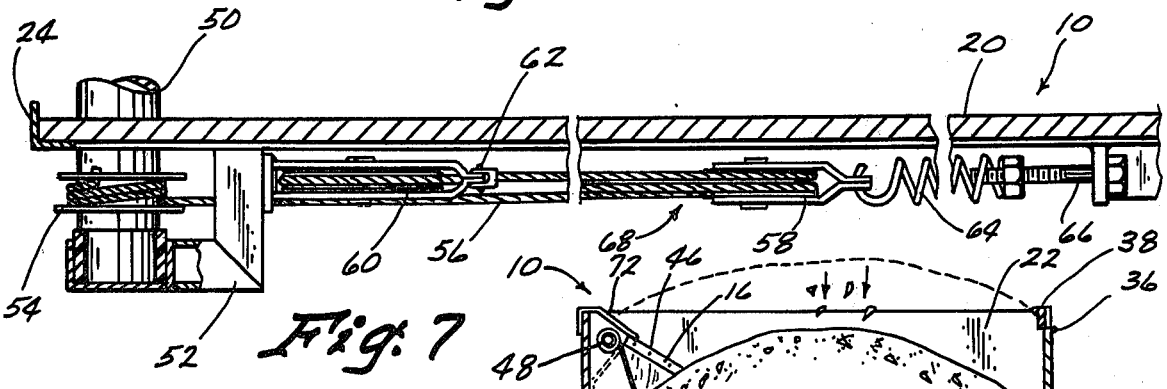
FIG. 7 is an enlarged top view as seen along the line 7—7 of FIG. 6.
Figure 10:
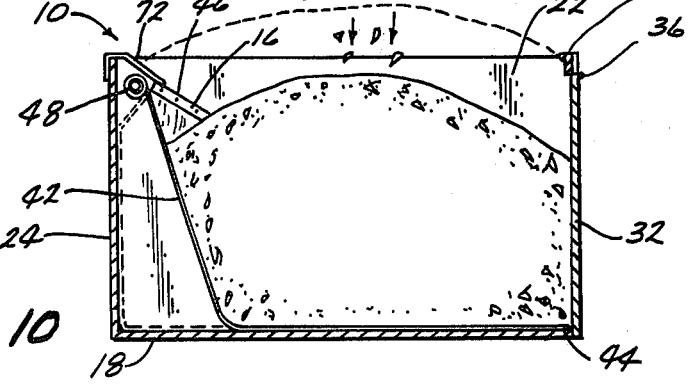
FIG. 10 is a view, like FIG. 8, but showing the container about three quarters full.

FIGS. 6 and 7 best show the means for controlling the roller for the liner in the near compartment, but it will be understood that the structure is the same at both ends of the container. The projecting end of the shaft 50 is journalled in a support or bracket 52 which is affixed to the adjacent end wall. This bracket is spaced outwardly from the end wall and that portion of the shaft between the bracket and the end wall has affixed thereto a a sheave 54 about which a cable 56 is wound. The cable extends to and returns from a second sheave 58, is wrapped about an intermediate or third sheave 60, carried by the bracket 52, returns to the sheave 58 and thence back toward the bracket 52 where it is dead-ended at 62. The second sheave 58 is connected by biasing means in the form of a tension spring 64 to a bracket or anchor 66 adjacent to the lower front of the adjacent end wall. The means just described, comprising the cable, sheaves and tension spring provides a spring-loaded cable-sheave device 68.

As added protection to the material being loaded, the divider wall is provided along its top edge with a strip of relatively soft cushioning material 70, and the roller-wound ends of the liners are protectively covered by yieldable cushioning material 72. This material, however, may be a bit stiffer than the material at 70 so as to insure winding of the liner without excessive wrinkling and to serve as a stripper to prevent left-over material from being wound up along with the liner.

Figure 5:
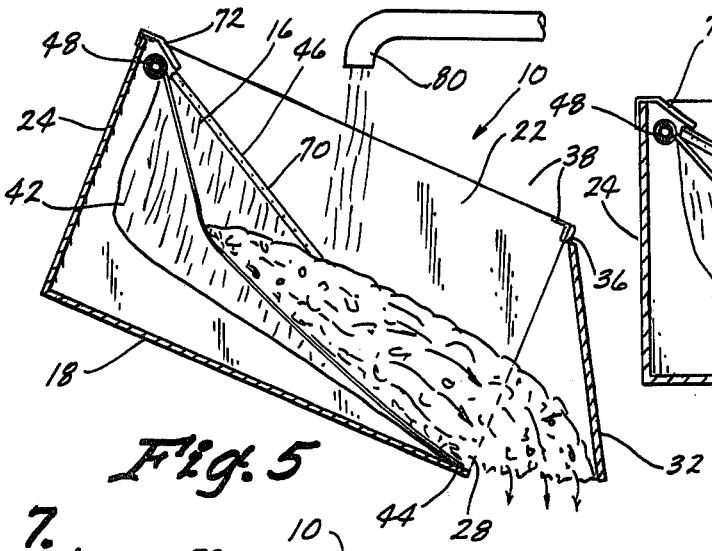
FIG. 5 is a section like FIG. 2 but showing the container tilted for unloading.
Figure 9:
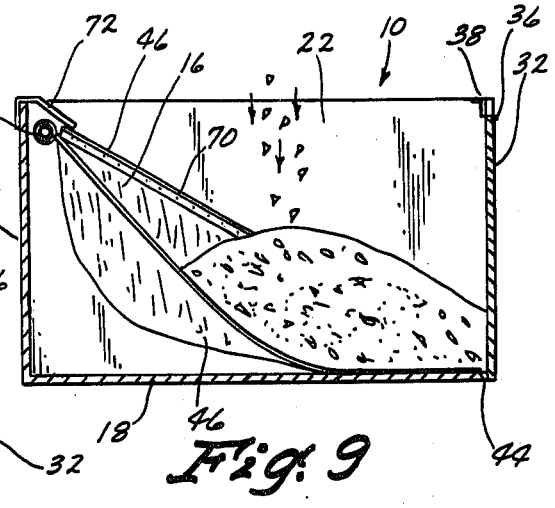
FIG. 9 is a view, like FIG. 8, but showing the container about one fourth full.

As stated before, when the compartments are being loaded, the liners span their respective compartments hammock fashion. As the weight of the oncoming load increases, the spring and cable devices 68 yield and allow the liners to sag gradually, permitting the load to approach the floor of the compartment and cushioning added material as it drops into the compartment. When the compartments are fully loaded, the liners will occupy the position shown in FIG. 4. Unloading may be accomplished by opening the doors 30 and 32, preferably by also tilting the container (FIG. 5). A water spount 80 can be used to assist in the unloading process (FIG. 5). As the compartments begin to discharge, the load of course lightens and the spring and cable devices cause the liners to re-wind on their respective rollers, elevating the liners and increasing their slope toward the discharge opening. Since the compartments are separate, they may be loaded and unloaded individually. The container may be further divided so that the compartments are separately tiltable.

The invention finds primary utility in the handling and transport of relatively delicate, perishable commodities such as fruit and vegetables, but it may be employed in other instances where similar objects are sought to be achieved.

We claim:

1. A container having a floor and a plurality of walls, including a divider wall providing the container with a pair of side-by-side compartments, each compartment having a discharge opening in side-by-side relationship and each having a movable wall selectively operative to open and close its discharge opening, a pair of flexible, bag-like liners, one disposed in each compartment, each liner having a lower edge thereof affixed to the floor along the respective discharge opening and having its opposite, upper edge disposed adjacent the top of the wall opposite said discharge opening, a pair of separate rollers journalled at and along the respective opposite walls and connected respectively to the liner upper edges, said rollers being coaxially disposed, and a pair of means connected respectively to the rollers for selectively rotating the rollers to wind and unwind the liners to facilitate loading and unloading of the compartments.

2. A container according to claim 1, in which the means are separate from each other for selectively rotating the rollers individually.

3. A container according to claim 1, in which each means is biased to yield and allow descent of its liner during loading and to recover to raise its liner during unloading.

4. A container according to claim 3, in which each means includes a shaft projecting outwardly from the container, a sheave affixed coaxially to the shaft, and a cable and spring device connected to the sheave.

5. A container according to claim 4, in which the discharge openings are in side-by-side relationship, the rollers are coaxially disposed, one roller has a shaft projecting beyond one end of the container and the other roller has a shaft projecting beyond the opposite end of the container, and each shaft has a sheave, cable and spring device connected thereto.

6. A container according to claim 5, in which the rollers are separate from each other, the shafts are separate from each other, and the sheave, cable and spring devices are separate and individually effective on their respective rollers and liners.

7. A container according to claim 1, including a covering of yieldable material disposed protectively over the top of the divider wall.

8. A container according to claim 1, including a covering of yieldable material disposed protectively over the container edges adjacent to the rollers.

9. A container according to claim 1, in which the compartment discharge openings are side-by-side and the container as a whole is tiltable toward the side containing said discharge openings.

10. A container having a compartment with a floor and a plurality of walls, each compartment having a discharge opening and having a movable wall selectively operative to open and close its discharge opening, a flexible liner disposed in said compartment, said liner having a lower edge thereof affixed to the floor along the discharge opening and having its opposite, upper edge disposed adjacent the top of the wall opposite said discharge opening, a roller journalled at and along the opposite wall and connected to the liner upper edge, means connected to the roller for selectively rotating the roller to wind and unwind the liner to facilitate loading and unloading of the compartment, said rotating means being biased to pull the liner flat when no load is on it and adapted to yield and allow descent of its liner during loading and to recover to raise its liner during unloading and including a shaft projecting outwardly from the container, a sheave affixed coaxially to the shaft, and a cable and spring device connected to the sheave, and sealing means attached to each of the side edges of said liner and to the top side edges of the compartment side walls, said sealing means comprising a flexible material having a first position corresponding to the substantially flat portion of the liner wherein a portion of the sealing means hangs below the liner, and a second position corresponding to the position when the liner conforms to the movable wall and the wall opposite the movable wall and to the bottom of the compartment wherein said sealing means conforms to the side walls of the compartment.

11. Apparatus for gently loading and unloading aggregate goods comprising:

a container having a bottom and first, second, third and fourth sidewalls, said first and third sidewalls being opposite with respect to each other and the second and fourth sidewalls being opposite each another;

means for selectively opening said first sidewall for unloading aggregate materials loaded into the container;

a roller shaft rotatably journalled to the upper edges of said second and fourth sidewalls adjacent to said third wall;

liner means attached at one end thereof to said roller shaft along substantially the entire length of said third sidewall, the opposite end of said liner being attached to the bottom adjacent to and along substantially the entire length of said first wall;

means for rotatively biasing said roller shaft in one rotational direction whereby said one end of the liner will be rolled up onto said roller shaft, said biasing means comprising flexible line means fixed at one end thereof to said roller shaft, guide means on said roller shaft for guiding said flexible line as it is wrapped around said roller shaft, first bracket means attached to said container and to the other end of said flexible line, first pulley means rotatably attached to said bracket means for receiving a portion of said flexible line therearound, second bracket means having second and third pulley means rotatably attached thereto, said first and second pulley means being mounted along an identical axis, a tension spring connected at one end thereof to said second bracket means; spring adjusting means connected at one end thereof to the other end of said tension spring and at the other end thereof to said container for selectively increasing or decreasing the tension said tension spring will exert on said bracket, said flexible line passing from the point of connection on said roller shaft over said second pulley means, then over the first pulley means, then over the third pulley means and, from the third pulley means to the point of connection to the second bracket means whereby the force of said spring is amplified through said first, second and third pulley means.

12. The apparatus of claim 11 including, sealing means attached to each of the side edges of said liner and to the top side edges of the compartment second and fourth sidewalls, said sealing means comprising a flexible material having a first position corresponding to the substantially flat portion of the liner wherein a portion of the sealing means hangs below the liner, and a second position corresponding to the position when the liner conforms to the first and fourth sidewalls and to the bottom of the compartment wherein said sealing means conforms to the second and fourth sidewalls of the compartment.

* * * * *